US006925841B2

(12) United States Patent
Heydt, Jr.

(10) Patent No.: US 6,925,841 B2
(45) Date of Patent: Aug. 9, 2005

(54) CLOSING ELEMENT ASSEMBLY FOR COMPOUND NEEDLES USED IN KNITTING MACHINES

(75) Inventor: Douglas L. Heydt, Jr., Shillington, PA (US)

(73) Assignee: Chima, Inc., Reading, PA (US)

( * ) Notice: Subject to any disclaimer, the term of this patent is extended or adjusted under 35 U.S.C. 154(b) by 77 days.

(21) Appl. No.: 10/606,651

(22) Filed: Jun. 26, 2003

(65) Prior Publication Data

US 2004/0261463 A1 Dec. 30, 2004

(51) Int. Cl.[7] ..... D04B 35/06
(52) U.S. Cl. ..... 66/120; 66/116
(58) Field of Search ..... 66/116, 120, 203, 66/204, 207, 208

(56) References Cited

U.S. PATENT DOCUMENTS 2,913,888 A * 11/1959 Amidon ..... 66/204
3,952,551 A * 4/1976 Kohl ..... 66/120
4,222,249 A * 9/1980 Winter ..... 66/120
4,317,342 A * 3/1982 Kohl ..... 66/120
4,397,160 A * 8/1983 Winter et al. ..... 66/120
5,966,969 A * 10/1999 Mista ..... 66/206
6,151,929 A * 11/2000 Mista ..... 66/207

* cited by examiner

*Primary Examiner*—Danny Worrell
(74) *Attorney, Agent, or Firm*—Dority & Manning, P.A.

(57) ABSTRACT

A closing element assembly is provided for closing hooking elements within a knitting machine. The assembly has a plurality of closing elements with each closing element having a butt end and a working end. The butt end defines at least one indention along the length of the butt end. At least one plate is provided for receipt in the indention. The plate defines closing element channels therein for receipt of a portion of the butt ends of the plurality of closing elements. The plate secures the plurality of closing elements in proper position for cooperating with a plurality of hooking elements of compound needles within a knitting process.

26 Claims, 6 Drawing Sheets

CLOSING ELEMENT ASSEMBLY FOR COMPOUND NEEDLES USED IN KNITTING MACHINES

BACKGROUND OF THE INVENTION

Needles have always been an integral part of the warp knitting process. In the past different types of needles have been used in different machines. Two predominate types of warp knitting machines in use today are the Tricot machine and the Raschel machine. Historically, the Tricot machines used bearded needles in forming a warp knit, while Raschel machines only used latch needles. With the production of modern warp knitting machines, however, compound needles replaced bearded needles in Tricot machines and also penetrated into the Raschel machine market.

Compound needles allowed for faster production on a warp-knitting machine due to their unique construction making them more desirable to warp knit manufacturers using Tricot machines. A compound needle possesses two distinct parts which form the needle: the hooking element and the closing element, or closure blade. The hooking element and closing element of a compound needle work in concert to form the proper knit while having discrete movements within the warp-knitting machine during the knitting process.

The hooking element includes a hook, a stem and a butt. The hook is a curved member used to catch and hold the yarn being knitted into the warp knit. The stem extends from the hook down to the butt of the hooking element. The butt is used to hold and manipulate the hooking element within the warp-knitting machine. The hook, the stem and butt of the hooking element are aligned in such a manner that the curved portion of the hook is in the same plane as the stem and the butt. The stem of the hooking element possesses a groove on the side to which the hook of the hooking element is opened. The closing element includes a blade and a butt. The blade is on the working end of the closing element which interacts with the hooking element during the knitting process, while the butt aids in holding and manipulating the closing element within the warp knitting machine.

During the knitting process, the blade of the closing element operates within the groove in the stem and closes off the open end of the hook. Due to the small size of the needles, a low tolerance exists for the alignment of the closing elements and the hooking elements. The angle of the blade of the closing elements and the blades alignment with the groove in the stem of the hooking element need to be near perfect for proper operation of the warp-knitting machine and to prevent breakage of the needle parts. Further, a warp knitting machine uses many evenly spaced needles in close proximity to each other within the warp-knitting machine.

To increase efficiency and easy of maintenance, the closing elements are grouped together in closing elements assemblies usually in groups of 14, 16, and 18 per half inch. These closing element assemblies, usually called castings, are formed by having closing elements aligned in a caster with proper spacing and pitch. Molten tin then is poured into the caster encasing the butt end of the closing elements. The butt ends of the closing elements are immersed in the tin constituting the actual casting, while the working end is left exposed. The castings are then removed from the caster and further shaped and manipulated to ensure proper alignment for interacting with the hooking elements in the warp knitting machines. While the use of castings improve the efficiency of maintaining the warp-knitting machine, the closing element casting formation and use also produce a myriad of issues. These issues include precision problems, concerning true gauge, blade alignment and sizing, and weight issues within the operation of the warp knitting machines.

True Gauge is defined as the securing of individual closing elements in parallel positions to each other and at a specific, equal distance apart. Such positioning of the closing elements presents an elusive target for a casting for many reasons. Most significant is that the molten tin must undergo a phase change from liquid to solid during the casting process. The molten tin is poured into the casters at over 600° C. As the casting cools and shrinks, the closing elements' optimal positionings are disturbed within the caster, adversely affecting the true gauge. The closing elements often have to be manipulated back into a parallel and equidistant position.

Blade alignment is defined as the pitch or angle of the blade in the assembly. Just as with true gauge, blade alignment is a critical requirement, since the closing elements of each casting are running at close tolerances and high speeds in a large and complicated machine. The casting process often affects blade alignment as it affects true gauge. The blade portion of the closing elements must be manipulated with pliers and other tools to return them to their desired angle. This manipulation of the closing elements to produce the desired conformance for both true gauge and blade alignment causes a loosening of the closing elements within the cavity of the castings increasing the chance of failure of the casting when put into use.

Sizing is defined as the measurement requirements for the exterior of the castings in order to properly fit into the warp-knitting machine. Sizing presents another problem for the casting product. The castings must be held tight in the warp-knitting machine due to the precise nature of the interaction of the hooking element and the closing elements and the speed at which the machines operate. These operational necessities of the warp-knitting machine require precise specifications for the press, or thickness, of the castings and width of the castings. No raw casting can achieve this requirement. Therefore, the tin covering the butt end of the closing elements must be brought within the specification through a secondary manufacturing procedure call shaving.

In the shaving process, the casting manufacturers use special files and other tools to manually remove excess tin from the width (the sides and back of the casting surrounding the butt ends of the closing elements) and the thickness (the top and bottom of the casting surrounding the butt end of the closing elements) to bring the castings within the required specifications. The shaving processes often disturbs the blade positioning through handling, or through the application of force, requiring correction to achieve the true gauge and desired blade alignment. The manual shaving process is both time consuming and costly.

Another precision issue, which arises concerning the use of castings, is the inconsistency of the molding process. There are many molds used throughout the world that produce castings for use in warp knitting machine, and no two molds can exactly reproduce identical parts, sometimes causing a problem in a knitting machine. Having castings from different molds increase the handling time needed during the shaving process. Further, all casting molds deteriorate over time causing additional problems in the reproducibility of the castings from deteriorated molds and increasing the time and effort put forth in the manual shaving process.

A further concern in warp knitting operations that warp knitters are always looking to improve is the weight of component parts. The use of tin to create a solid base surrounding the butt ends of the closing elements within the castings creates a firm foundation which holds the closing elements in their proper position during the operation of the warp-knitting machine. However, in the same vein, the solid casting of tin adds excess weight to each casting. While each casting containing the closing elements is not a heavy component part, when considering the number of castings of closing elements used in a single warp knitting machine, the total weight of all the castings is not insignificant. When taking into consideration the high rate of speed at which the warp knitting machines operate, the force created by this gross weight grows exponentially. This force produced by the speed and weight creates additional stress and wear on the warp-knitting machine. Avoiding such additional stress and wear increases the life of the component parts running the warp knitting machines as well as the life of the warp knitting machines themselves.

SUMMARY OF THE INVENTION

A principal aspect of the present invention is to engineer two components, plates and closing elements, in such a manner as to ensure the correct blade pitch and true gauge as well as a precise finished assembly width, press and length. An additional aspect of the invention is to reduce the amount of manipulation of the closing elements within closing element assemblies needed to produce the desired conformance for both true gauge and blade alignment, thereby preventing a loosening of the closing elements within the closing element assemblies. By preventing a loosening of the closing elements within the closing element assemblies, the chance of failure of an assembly decreases when put into use within the warp-knitting machine.

Another aspect of the present invention is to provide more precise specifications for the press and width of the closing element assemblies, thereby eliminating the timely and costly shaving process which also disturbs the blade positioning through handling, and/or through the application of force. A related aspect of the present invention is to improve the reproducibility of the closing element assemblies to ensure conformity of the assemblies.

A further aspect of the present invention is to reduce the excess weight of the closing element assemblies while maintaining a desired level of rigidity in the assemblies to preserve the closing element's true gauge and blade alignment. Additional aspects and advantages of the invention will be set forth in part in the following description, or may be obvious from the description, or may be learned through practice of the invention.

In accordance with the aspects of the present invention, a closing element assembly is provided for closing hooking elements within a warp knitting machine. The closing element assembly has a plurality of closing elements with each closing element having a butt end and a working end with the butt end defining at least one indention along the length of the butt end. At least one plate for receipt in the indention is provided. The plate defines closing element channels therein for receiving a portion of the butt ends of the plurality of closing elements. These closing channels may be slots or grooves or a combination thereof. The plate secures the plurality of closing elements in proper position for cooperating with a plurality of hooking elements of compound needles in a knitting process.

In another embodiment, the butt ends of the closing elements possess at least one upper flange forming an upper indention and at least one lower flange forming a lower indention on opposing sides of the butt ends. An upper plate pre-engineered to accept the upper flange of each butt end of the closing elements secures the upper flange of each butt end and is firmly carried in the upper indention. In the same manner, a lower plate pre-engineered to accept the lower flange of each butt end of the closing elements holds the lower flange and is securely carried in the lower indention. These upper and lower plates fasten the closing elements to ensure proper positioning of the working end of the closing elements within the warp knitting machine.

In one embodiment, the closing element assembly possesses a plurality of closing elements with the butt end of each closing element having an upper pair of opposing flanges forming an upper indention and a lower pair of opposing flanges forming a lower indention. An upper plate contains slots on one side for receiving upper flanges of the closing elements' butt ends which are nearest to the working ends of the closing elements. The upper plate is carried in the upper indentions of the butt ends formed by the upper pairs of opposing flanges. Similarly, a lower plate has slots on one side for receiving lower flanges of the butt ends of the closing elements nearest to the working ends. The lower plate is carried in the lower indentions of the butt ends formed by the lower pairs of opposing flanges. As above, the upper and lower plates secure the closing elements in proper alignment, spacing and angle for use with the hooking elements of compound needles.

An adhesive substance can be added to the plate or plates and/or the butt ends of the closing elements in these embodiments to further secure the closing elements in proper position.

The invention includes special closing elements for providing closure to the compound needles. Each closing element includes a working end which interacts with a groove in the hooking element of the needle to close the needle during the knitting process. Each closing element also possesses a butt end integral to the working end. The butt end allows for proper alignment and spacing of the working end of each closing element. The butt end of each closing element forms at least one indention. In some embodiments, the butt end may form both an upper indention and a lower indention.

Further, the invention includes a special plate technology for securing proper positioning of closing elements in a knitting machine. The plate forms a plurality of closing element channels. Each of these closing element channels permit a closing element to be received into that closing element channel, thereby securing the closing element in proper alignment, spacing and angle for use during the knitting process. These closing element channels may be slots or grooves or any combination thereof. In an advantageous embodiment, the plate is construct from a metal such as aluminum.

Other features of the present invention will be described in greater detail below through the use of the appended figures.

DETAILED DESCRIPTION

Reference will now be made in detail to the presently preferred embodiments of the invention, one or more examples of which are shown in the Figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
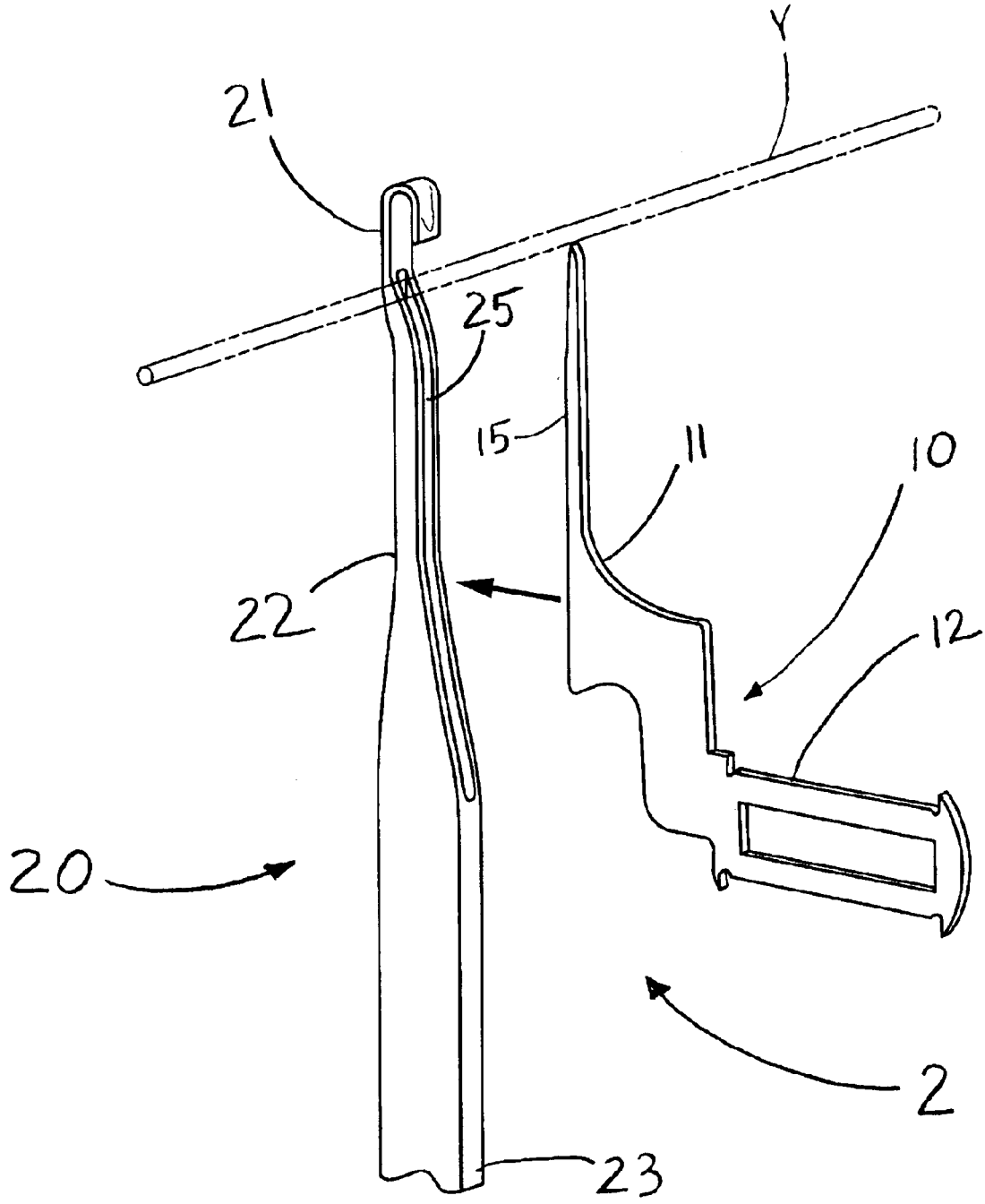
FIG. 1 is an exploded view of a compound needle according to the present invention used in a warp-knitting machine.
Figure 2:
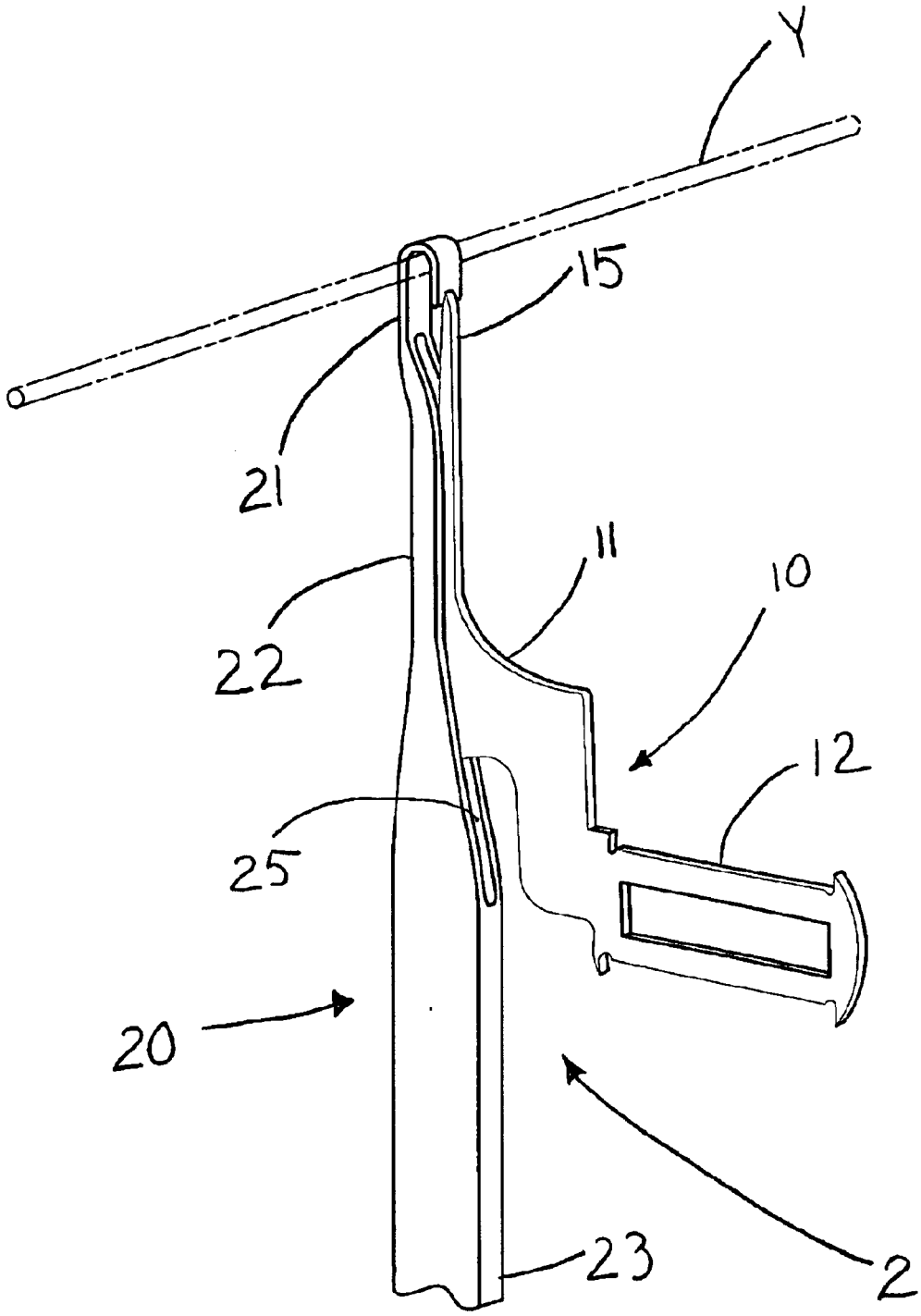
FIG. 2 is a perspective view of a compound needle according to the present invention used in a warp-knitting machine with the closing element in a closed position within the groove of the stem of a hooking element.

FIGS. 1 and 2 show a compound needle that operates within a warp-knitting machine. FIG. 1 shows, in an exploded view, a compound needle generally 2, which is used in warp knitting machines and has two discrete parts. Compound needle 2 possesses a hooking element generally 20 and a closing element, or closure blade, generally 10. The hooking element 20 has a hook 21 at its one end for catching and maneuvering a yarn Y during the warp knitting process. A stem 22 extends from the hook 21 down to a butt 23. As illustrated, hook 21, stem 22 and butt 23 of hooking element 20 are aligned in such a manner that the curved portion of hook 21 is in the same plane as stem 22 and butt 23. On the side of hooking element 20 on which the hook 21 opens, stem 22 forms a groove 25.

Closing element 10, which has a working end 11 and a butt end 12, opens and closes hook 21 of hooking element 20 during the warp knitting process. Working end 11 terminates as a blade 15 which operates in groove 25 of stem 22 leaving hook 21 open while the hook 21 is contained in a loop of yarn of the knit (not shown). As hooking element 20 rises within a loop of yarn, closing element 10 also rises in a like manner keeping hook 21 open. Guide bars (not shown) bring a yarn Y over into a position that allows open hook 21 to catch yarn Y. As shown in FIG. 2, once yarn Y has been caught by hook 21, closing element 10 is moved forward within groove 25 of stem 22 relative to hooking element 20, where blade 15 of closing element 10 closes hook 21, so that as the compound needle 2 is pulled downward by the warp knitting machine out of the loop, the closed hook 21 of hooking element 20 pulls the yarn Y with it, while blade 15 of closing element 10 prevents the catching of the loop as the compound needle exits the loop. The yarn Y which is pulled through by the closed compound needle forms the next loop, and the knitting step begins anew.

Interaction between working end 11 of closing element 10 and groove 25 requires precision alignment and movement of both hooking element 20 and closing element 10. The movement of hooking element 20 is controlled by the warp-knitting machine at butt end 23. Similarly, the movement of closing element 10 is controlled by the warp-knitting machine at butt end 12. Many compound needles are used in just one warp-knitting machine. It is therefore advantageous to group neighbor hooking elements into a multiple hooking element assembly and, likewise, neighboring closing elements into multiple closing element assemblies to increase the efficiency of handling the compound needles. Advantageously, a new assembly of closing elements according to the present invention allows for a more precise construction of the assembly which weighs less than the casting used historically within the industry.

Figure 3:
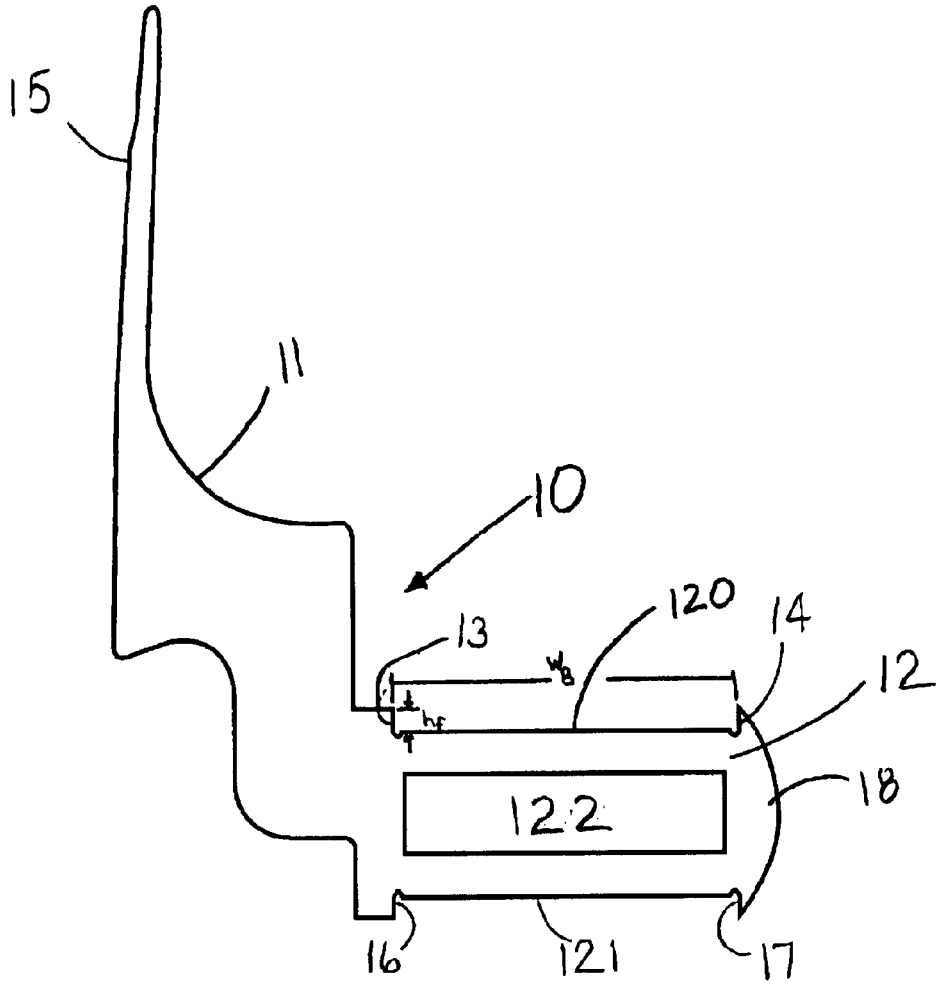
FIG. 3 is a side view of a single closing element according to the present invention which is used within a warp-knitting machine.

Historically, a butt end of a closing element had a rectangular shape with one end integral to the working end of the closing element. After casting, the end of the casting furthest from the working end was rounded to increase the ease of installation of the casting into the warp-knitting machine. FIGS. 1, 2 and 3 show a new design for a closing element 10 having a working end 11 and a butt end 12. As with traditional closing elements, working end 11 of closing element 10 has a blade 15 which interacts with a hooking element to close the hook of the hooking element. Butt end 12 possesses a rounded rear 18 on the end opposite working end 11 which, in the closing element assembly according to the invention, serves a similar purpose as the rounded end of conventional castings.

Instead of just the traditional rectangular shape of a conventional closing element, butt end 12 of closing element 10 is provided with special indentions. In the shown embodiment, flanges form these indentions. Flanges are defined herein as any structure which forms a wall, or shoulder, of an indention. Between the rounded rear 18 of butt end 12 and working end 11, top flanges 13, 14 form an upper indention 120 and bottom flanges 16, 17 form a lower indention 121 in butt end 12. The flanges 13, 14, 16, 17 may be formed by a precise cutting process after the closing element 10 is created, or during the casting or stamping of the closing element 10 itself. These flanges 13, 14, 16, 17 serve an important purpose in the new assembly of multiple closing elements by allowing a plate to be seated in the indentions and around the flanges, thereby holding the closing elements in proper position and organization. Also, butt end 12 can have an aperture 122 defined therethrough as shown in FIG. 3, which helps to reduce the weight of the closing element. The casting or the stamping of the closing element 10 can form the aperture 122, or a cutting procedure may create the aperture 122 after closing element 10 is made. However, these apertures 122 are not necessary to the invention.

Figure 4:
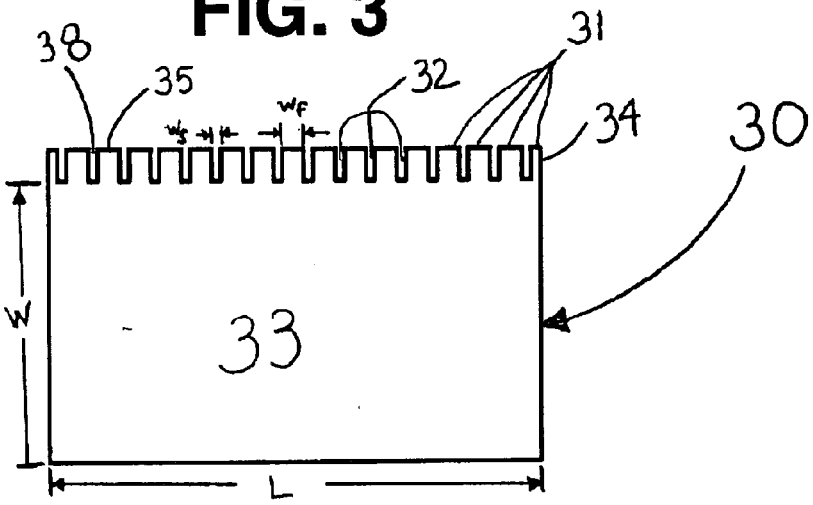
FIG. 4 is a top view of a plate according to the present invention used in holding a plurality of closing elements in a closing element assembly.

FIG. 4 shows a plate generally 30 having a body 33 in a rectangular shape with plate teeth 31 integral to one side of body 33. Plate 30 forms closing element channels 38 to accept closing elements to secure them in proper positioning within a closing element assembly. Plate teeth 31 create closing element channels 38 in the form of slots 32 which are located between plate teeth 31. Uniform spacing of the teeth 31 creates a uniform width $w_s$ for slots 32. Referring to both FIG. 3 and FIG. 4, the width $w_s$ of the slots 32 should correspond to the width of a closing element, in particular, the width of the flanges 13, 14, 16, 17 formed in the butt end 12. The length L of the body 33 allows for consistent spacing and alignment of the closing elements to ensure that the closing elements are in proper alignment with the corresponding grooves along the stems of the corresponding hooking elements. Therefore, the length L of the plate body 33 should correspond to the width of the number of closing elements contained in an assembly plus the spacing between the hooking elements of the compound needle with which the closing elements interact and the width of end teeth 34.

Two types of plate teeth 31 are provided: inner plate teeth 35 and end teeth 34. The width $w_f$ of inner plate teeth 35 correspond to the spacing of the closing elements that ensures proper operation of the closing elements with the hooking elements. A consistent spacing is important, so all the inner plate teeth 35 should have the same width $w_f$. However, plate 30 also contains end teeth 34 at either end of the row of inner plate teeth 35. These end teeth 34 have a different width from the width of the inner plate teeth 35 to ensure that, when the assemblies are installed in the warp knitting machines, the spacings between adjacent assemblies allows for proper alignment of the outer most closing elements with its corresponding hooking element. In a further embodiment, the width of end teeth 34 is less than one half the width of inner plate teeth 35.

As shown in FIGS. 3 and 4, plate body 33 possesses a width W. Referring to FIG. 3, the upper indention 120 formed by top front flange 13 and top back flange 14 has a width $W_B$. The width W of the plate body 33 should correspond to width $W_B$ of the upper indention 120. The corresponding widths of width W of the plate body 33 and width $W_B$ of the upper indention 120 as well as the corresponding widths of width $w_s$ of slots 32 and the width of upper front flanges 13 and/or upper back flange 14 permit a press fit between plate 30 and upper flanges of the closing elements. In the same manner, plate 30 can be press fit into lower indention 121 and around lower front flange 16 and/or lower back flange 17.

In the shown embodiment, top front flange 13 is in a linear plane with bottom front flange 16 and top back flange 14 is in a linear plane with bottom back flange 17, so that upper indention 120 and lower indention 121 have a same width $W_B$. This design allows plates 30 to be interchangeable, i.e., to be press fit into lower indention 121 or upper indention 120. Such design lowers production costs associated with making the plates 30 as well as factory inventory.

Upper flanges 13, 14 have a height $h_f$ which corresponds to the depth of upper indention 120. The height $h_f$ also corresponds to the thickness and/or gauge of plate 30, so that when plate 30 is press fit into the corresponding upper indentions, plate 30 sits flush with the outer extremity of top upper flanges 13, 14. In a preferred embodiment, lower flanges 16 and 17 have the same height $h_f$ as upper flanges 13, 14 allowing plates 30 to be interchangeably press fit into upper indentions 120 or lower indentions 121. In such a manner the precise press, or thickness, of the closing element assembly can be achieved for insertion into the knitting machine.

Figure 5:
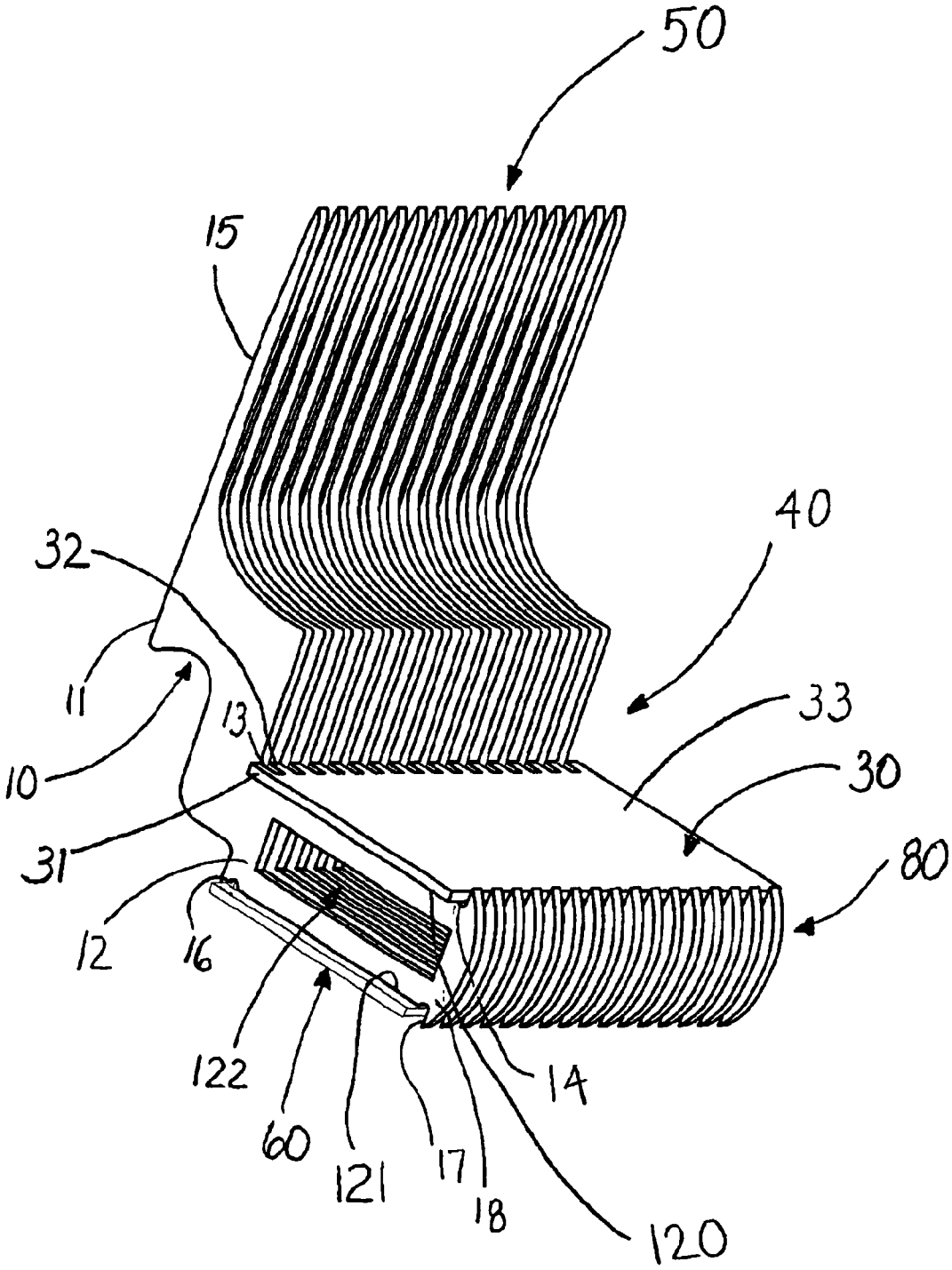
FIG. 5 is a perspective view of a closing element assembly containing an upper plate and lower plate holding a plurality of closing elements in proper alignment and positioning relative to each other for use in a warp knitting machine.

Plate 30 is a pre-engineered form which is created before the forming of a closing element assembly generally 40 (see FIG. 5). Plate 30 can be formed in various ways including stamping, casting and machining of a metal, or a combination thereof. In a preferred embodiment, plate 30 is formed by stamping the plate from a sheet of metal using a tool and die. Depending on the material used to construct plate 30, it may be hollowed in its middle. In a further embodiment, plate 30 is made from aluminum.

The depth or gauge of plate 30 is restricted by the full height of butt end 12 of closing element 10 and the dimensions within the warp-knitting machine provided for the closing element assemblies. The gauge of the plate or combination of plates used in an assembly should not exceed these dimensions of the warp-knitting machine. The gauge of plate 30 should be thick enough to provide a desired rigidity and durability to the closing element assembly without adding unnecessary weight. Also, the gauge of plate 30 should be thick enough to prevent excessive deformation of plate teeth 31 which can cause undesirable looseness in the closing element assembly. In one embodiment, a gauge of 15 thousandth of an inch is used. At any rate, as stated above, the height $h_f$ of flanges 13, 14, 16, 17 and, thereby, the depth of upper and lower indentions 120, 121 should correspond to the gauge or thickness of plate 30 which is to be seated in the indentions.

Figure 7:
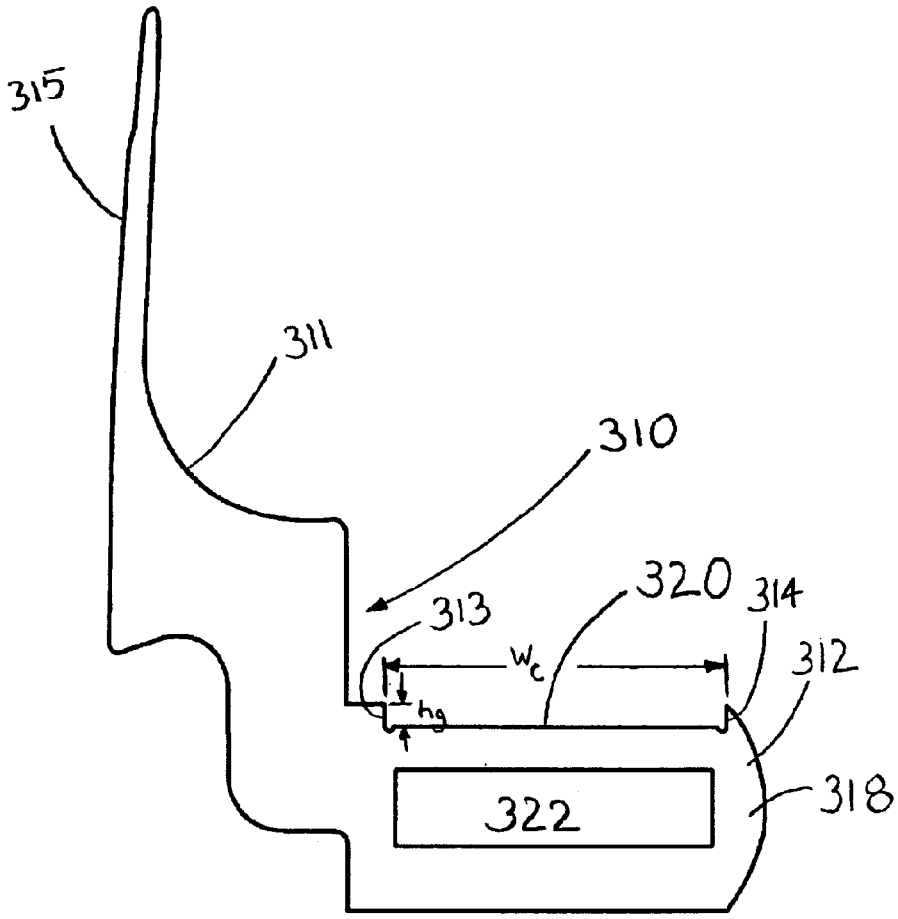
FIG. 7 is a side view of another embodiment of a single closing element according to the present invention which is used within a warp-knitting machine.
Figure 8:
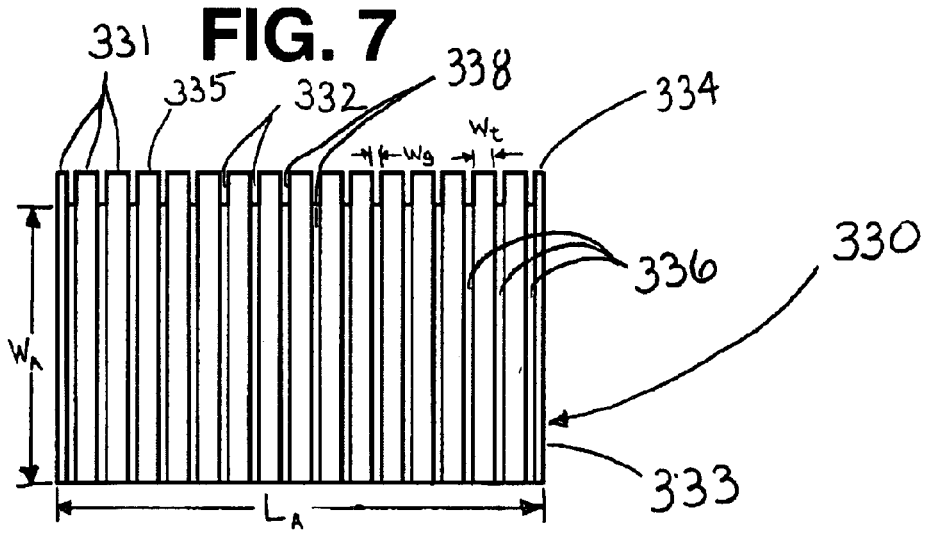
FIG. 8 is a bottom view of another embodiment of a plate according to the present invention used in holding a plurality of closing elements in a closing element assembly.

Another embodiment of the present invention is shown in FIGS. 7 and 8. FIG. 7 shows a closing element 310 similar to the closing elements described above. Like the closing elements described above, closing element 310 has a working end 311 and a butt end 310 as well as a rounded rear 318. However, butt end 310 forms only one indention 320. Indention 320 is formed by front flange 313 and back flange 314 with each flange 313, 314 have a height $h_g$ which corresponds to the depth of indention 320. An aperture 322 may also be formed in butt end 312 to aid in decreasing the weight of closing element 310.

To form the closing element assembly using the closing element 310 depicted in FIG. 7, a different plate design is employed as shown in FIG. 8. Plate 330 is also similar to the plates described above. However, Plate 30 is made from a thicker material. Plate 330 has a plate body 333 in a rectangular shape with plate teeth 331 integral to one side of plate body 333 with plate teeth 331 forming slots 332 therebetween. As above, preferably plate teeth 331 are comprised of inner teeth 335 and end teeth 334 with inner teeth having a larger width $w_t$ than the width of end teeth 334 to allow for proper alignment of the closing elements and closing element assemblies. Further, plate body 333 form grooves 336 extending within plate body 333 which are aligned with corresponding slots 332 formed by plate teeth 331. Grooves 336 and slots 332 formed by plate body 333 and plate teeth 331, respectively, possess the same width $w_g$. Plate body 333 and plate teeth 331 form closing element channels 338 embodied in the grooves 336 and slots 332 into which closing elements fit. The length $L_A$ of plate body 333 allows for consistent spacing and alignment of the closing elements to ensure that the closing elements are in proper alignment with the corresponding grooves along the stems of the corresponding hooking elements.

As shown in FIGS. 7 and 8, plate body 333 possesses a width $W_A$, while indention 320 formed by front flange 313 and back flange 314 has a width $W_C$. The width $W_A$ of the plate body 333 should correspond to the width $W_C$ of indention 320. The corresponding widths of width $W_A$ of the plate body 333 and width $W_C$ of indention 320 as well as the corresponding widths of width $w_g$ of slots 332 and grooves 336 and the width of front flanges 313 and/or back flange 314 make a press fit between plate 330 and upper flanges of the closing elements possible. A closing element 310 fits into each slot 332 and corresponding groove 336 in a manner that firmly secures each closing element 310 in proper position. An adhesive substance, such as a glue, can be added to plate 330 and/or the butt end 312 of closing elements 310 to increase the firmness with which the closing elements 310 are held in position.

Plate 330 can be formed in various ways including stamping, casting and machining of a metal, or a combination thereof. The thickness of plate body 333 at grooves 336 corresponds to height $h_g$ of flanges 313, 314 so that when plate 330 is seated into the corresponding indentions 320, plate 330 sits flush with the outer extremity of flanges 313, 314. The overall thickness or gauge of the plate 330 is large enough to allow only one plate to securely hold closing elements 310 in proper position to ensure true gauge and correct blade alignment.

A similar embodiment as shown in FIG. 8 is a plate having a plate body which forms grooves, but does not possess the plate teeth. These grooves formed by the plate body alone create the closing element channels for accepting closing elements. In such an embodiment, the width of each groove corresponds to the width of a closing element 310 as shown in FIG. 7. The plate body sits in the indentions of the closing elements with portions of the butt ends of the closing elements fitting securely within the grooves. In such a manner, a plate containing just grooves without slots formed by plate teeth can be used to form a closing element assembly.

Figure 6:
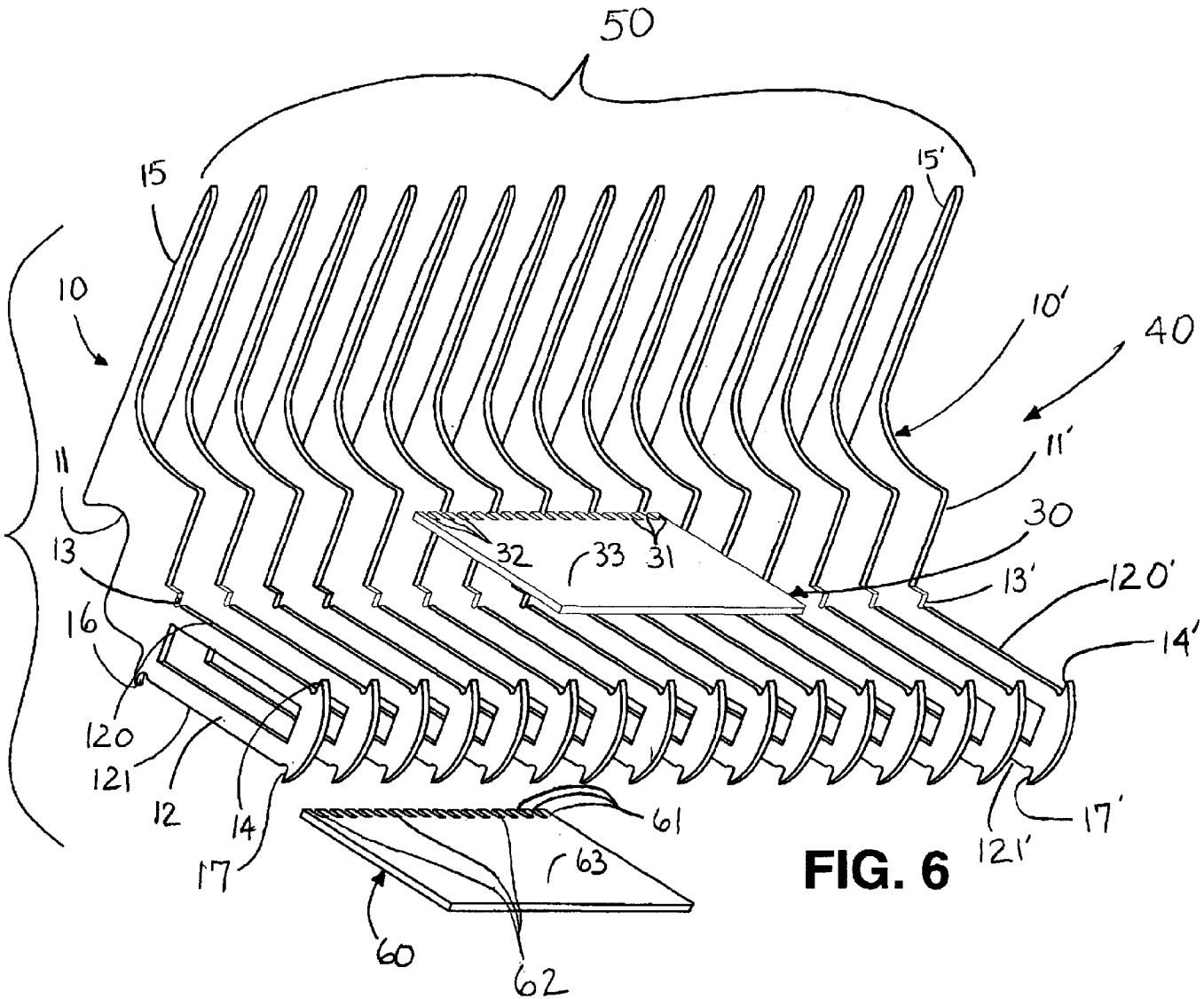
FIG. 6 is an exploded view of a closing element assembly shown in FIG. 5.

A constructed closing element assembly generally 40, as can be seen from FIG. 5, allows for precision spacing of the closing elements 10 (only one closing element is numbered for the sake of clarity), while rigidly and durably holding each closing element 10 in proper alignment for interacting with respective hooking elements. The exploded view of a closing element assembly 40 in FIG. 6 shows each component of the closing element assembly 40. An upper plate 30 and a lower plate 60 and a group generally 50 of closing elements 10, 10' are provided. The number of closing elements 10, 10' (only the first and the last closing element is numbered for the sake of clarity) in the group 50 of closing elements 10, 10' corresponds to the number of slots 32, 62 formed by plate teeth 31, 61 in the upper and lower plates 30, 60 respectively, and vice versa. In the shown embodiment, the number of closing elements 10, 10' is sixteen. Therefore, sixteen slots 32 in the upper plate 30 and sixteen slots 62 in the lower plate 60 are provided. The closing elements 10, 10' are aligned with both the upper plate 30 and the lower plate 60, so that each upper front flange 13, 13' aligns with a slot 32 of the upper plate 30 and each lower front flange 16 aligns with a slot 62 of the lower plate 60. The plate teeth 31, 61 of the upper and lower plates 30, 60 provide appropriate spacing of the closing elements 10, 10' for proper interaction of the working ends 11, 11' and in particular the blades 15, 15' with the respective hooking elements.

The possibility exists in a different embodiment of having plate 30 reversed so that plate teeth 31, 61 interact with upper back flanges 14, 14' and a lower back flange 17, 17'. Further, it also is possible to have a plate for use in an upper and lower position with two parallel rows of plate teeth on opposite sides of the plate body (not shown). One set of plate teeth would interact with the front flanges of the butt ends of the closing elements, while the other set of plate teeth would interact with the back flanges of the butt ends of the closing elements.

As upper and lower plates 30, 60 and the group 50 of closing elements 10, 10' are being press fit together, the upper front flanges 13, 13' fit tightly into the slots 32 of upper plate 30, while the lower front flanges 16 fit tightly into the slots 62 of lower plate 60. Further, body 33 of upper plate 30 fits tightly into upper indentions 120, 120' between upper flanges 13, 13', 14, 14', while body 63 of lower plate 60 fits tightly into lower indention 121, 121' between lower flanges 16, 17, 17'. An adhesive substance, such as a glue, can be added to upper and lower plate 30, 60 and/or the butt ends 12 of closing elements 10 to increase the strength and firmness with which upper and lower plate 30, 60 hold and fasten closing elements 10.

It is possible in some instances to use only friction to hold the closing element assembly together. As seen in FIG. 5, friction from the tightly fitted upper and lower plates 30, 60 in and around the group 50 of closing elements 10, 10' fasten closing elements 10 firmly in proper position. The precision in the formation of plates 30, 60 and closing elements 10 allow closing element assembly 40 to be formed using only friction between the fitted components to hold closing element assembly 40 together. Having plates securely in both an upper and lower position on opposite sides of butt ends 12 of the closing elements 10 adds greatly to the stability and precise alignment of closing elements 10 in the closing element assembly 40.

After press fitting the components together to form the assembly, upper plate 30 and upper plate teeth 31 sit flush with upper flanges 13, 14 and the lower plate 60 and lower plate teeth sit flush with lower flanges 16, 17, so that the assembly butt end 80 has a smooth top and bottom surface similar to the butt end of castings to permit installation into the warp knitting machine. At the same time, the upper and lower plates 30, 60 rest firmly against the bottom walls of the upper and lower indentions 120, 121, respectively, increasing the stability of the assembly 40. Upper and lower plates 30, 60 secure the individual closing elements 10 in parallel positions to each other and at a specific, equal distance apart. Rounded rears 18 of the butt ends 12 of the individual closing elements 10 replace the rounded rear of the old casting assemblies. These rounded rears 18 work in unison to aid in the installation and placement of closing element assemblies 40 into the warp-knitting machine.

Besides the difference in weight between the casting material, usually tin, and the plates 30, 60, the butt end 12 closing elements 10 form apertures 122 which further reduce the weight of the assembly 40. However, these apertures 122 are not necessary to the invention. Therefore, in some embodiments no aperture is formed in the butt end.

Once the upper and lower plates 30, 60 and group 50 of closing elements 10, 10' form assembly 40, the true gauge and blade alignment of the working ends 11 and blades 15 of closing elements 10 as well as the overall sizing of assembly 40, including the press, width and length are assured. Using plates 30, 60 to form closing element assembly 40 provides a more precise and more easily formed assembly than a casting. The use of this plate technology and the new design of closing elements provide a closing element assembly that consistently meets the necessary tolerances required for the closing element assemblies without undue handling and manipulation to bring it within tolerance. This new closing element assembly generally eliminates the need for the use of special files and other tools to manually size the assembly and properly align the closing elements within the assembly. This plate and closing element technology can improve the efficiency of manufacturing closing element assemblies, while at the same time decreasing the weight of these assemblies.

It should be understood that, while the closing element assemblies according to the invention are described in conjunction with warp knitting, such closing element assemblies made be used in other knitting processes wherein similar compound needles are used.

It will be appreciated by those skilled in the art that various modifications and variations can be made in the present invention without departing from the scope of the invention. It is intended that the present invention include such modifications and variations as come within the scope of the appended claims and their equivalents.

What is claimed:

1. A closing element assembly for providing closure to hooking elements within a knitting machine, said closing element assembly comprising:

a plurality of closing elements, each closing element having a butt end and a working end, said butt end defining at least one indention along the length of same;

at least one plate for receipt in said at least one indention, said plate defining closing element channels therein for receipt of a portion of said butt ends of said plurality of closing elements; and said at least one plate securing said plurality of closing elements in proper position for cooperating with a plurality of hooking elements of compound needles for knitting.

2. A closing element assembly as in claim 1, wherein said closing element channels defined by said plate are grooves form by said plate.

3. A closing element assembly as in claim 1, wherein said closing element channels formed by said plate are grooves and slots formed by said plate.

4. A closing element assembly as in claim 1, wherein said closing element channels formed by said plate are slots formed by plate teeth.

5. A closing element assembly as in claim 1, wherein an adhesive substance is applied to said plate.

6. A closing element assembly as in claim 1, wherein an adhesive substance is applied to said butt end of said closing elements.

7. A closing element assembly as in claim 1, wherein an adhesive substance is applied to said butt end of said closing elements and said plate.

8. A closing element assembly for providing closure to hooking elements within a knitting machine, said closing element assembly comprising:

a plurality of closing elements, each closing element having a butt end and a working end, said butt end defining an upper indention and a lower indention on opposing sides of said butt ends;

at least one plate for receipt in at least one of said indentions of said closing elements, said plate defining closing element channels therein for receipt of a portion of said butt ends of said plurality of closing elements; and said at least one plate securing said plurality of closing elements in proper position for cooperating with a plurality of hooking elements of compound needles for knitting, when said closing element assembly is placed within the knitting machine.

9. A closing element assembly as in claim 8, wherein an upper plate is receivable in said upper indentions formed in said butt ends of said plurality of closing elements and a lower plate is receivable in said lower indentions formed in said butt ends of said plurality of closing elements.

10. A closing element assembly as in claim 9, wherein said butt end of each closing element has two upper flanges forming said upper indention and has two lower flanges forming said lower indention.

11. A closing element assembly as in claim 9, wherein said upper and lower plates are press fit into said upper and lower indentions.

12. A closing element assembly as in claim 1, wherein said at least one plate is made of aluminum.

13. A closing element assembly as in claim 1, wherein said butt end of each closing element forms an aperture through said butt end.

14. A closing element assembly for providing closure to hooking elements of compound needles within a knitting machine, said closing element assembly comprising:

a plurality of closing elements, each closing element having a butt end and a working end, said butt end having an upper pair of opposing flanges forming an upper indention on said butt end and a lower pair of opposing flanges forming a lower indention on said butt end;

an upper plate defining slots on one side for receiving upper flanges of said butt ends nearest to said working ends of said closing elements, said upper plate carried in said upper indentions of said butt ends formed by said upper pairs of opposing flanges;

a lower plate defining slots on one side for receiving lower flanges of said butt ends nearest to said working ends of said closing elements, said lower plate carried in said lower indentions of said butt ends formed by said lower pairs of opposing flanges; and said upper and lower plates securing said closing elements in proper alignment, spacing and angle for use with the hooking elements of said compound needles.

15. A closing element assembly as in claim 14, wherein an adhesive substance is applied to said plate.

16. A closing element assembly as in claim 14, wherein an adhesive substance is applied to said butt end of said closing elements.

17. A closing element assembly as in claim 14, wherein an adhesive substance is applied to said butt end of said closing elements and said plate.

18. A closing element for providing closure to a compound needle used in knitting, said closing element comprising:

a working end which interacts with a groove in said needle to close said needle during the warp knitting process;

a butt end integral to said working end, said butt end allowing for proper alignment and spacing of said working end; and said butt end forming an upper pair of opposing flanges forming an upper indention in said butt end, and a lower pair of opposing flanges forming a lower indention in said butt end.

19. A closing element as in claim 18, further comprising a rounded rear on an end of said butt end furthest from said working end.

20. A closing element as in claim 18, wherein said butt end forms an aperture through said butt end.

21. A plate for use within a closing element assembly for securing proper positioning of closing elements in a knitting machine, said plate comprising;

a plate forming a plurality of closing element channels; and each of said closing element channels formed by said plate allowing a closing element to be receivable into said closing element channel securing said closing element in proper alignment to create a closing element assembly for use within said knitting machine.

22. A plate as in claim 21, wherein said closing element channels are grooves formed by said plate.

23. A plate as in claim 21, wherein said closing element channels are slots formed by said plate.

24. A plate as in claim 21, wherein said closing element channels are slots and grooves formed by said plate.

25. A plate as in claim 21, wherein said plate is metal.

26. A plate as in claim 25, wherein said plate is aluminum.

* * * * *